US006120323A

United States Patent [19]

Zhung et al.

[11] Patent Number: 6,120,323

[45] Date of Patent: Sep. 19, 2000

[54] ELECTRICAL CONNECTOR

[75] Inventors: Guo-Hua Zhung; Zi-Qiang Zhu; Guang-Zing Shi, all of Kun-San, China

[73] Assignee: Hon Hai Precision Ind. Co., Ltd., Taipei Hsien, Taiwan

[21] Appl. No.: 09/357,575

[22] Filed: Jul. 20, 1999

[51] Int. Cl.[7] ..... H01R 13/74

[52] U.S. Cl. ..... 439/567; 439/607; 439/545

[58] Field of Search ..... 439/567, 571, 439/572, 79, 545, 607, 609

[56] References Cited

U.S. PATENT DOCUMENTS 5,472,349 12/1995 Dixon et al. ..... 439/79
5,584,708 12/1996 Leong ..... 439/79
5,622,508 4/1997 Nagahata et al. ..... 439/79
5,772,453 6/1998 Tan et al. ..... 439/79
5,938,473 8/1999 Nishio et al. ..... 439/607

*Primary Examiner*—Gary F. Paumen
*Attorney, Agent, or Firm*—Wei Te Chung

[57] ABSTRACT

An electrical connector comprises a housing, a number of contacts, a front shell and a rear shell. The front shell forms two L-shaped boardlocks. The housing has two standoffs to support the boardlocks. Each boardlock has two resilient legs. Each leg forms a barb at a free end thereof for engaging with a mounting hole defined in a printed circuit board. The connector is then firmly mounted on the printed circuit board and the height of the connector above the circuit board is reduced.

12 Claims, 6 Drawing Sheets

ELECTRICAL CONNECTOR

BACKGROUND OF THE INVENTION

The present invention relates to an electrical connector, and more particularly to an electrical connector mounted on a circuit board through a cutout defined therein to reduce the height of the connector above the circuit board.

As notebook computers become further developed, space conservation is a continuing issue for designers. A conventional connector used in a notebook computer includes a pair of board mounting legs for soldering to a circuit board. As shown in FIGS. 6 and 7, positioning legs 8 downwardly extend from an electrical connector 80. When the connector 80 is soldered to the circuit board 9, the height of the connector 80 above the circuit board can not be reduced. Thus, space conservation within an enclosure 90 is not promoted. Examples of such connectors are disclosed in Taiwan Patent Application Nos. 85204902, 85212129, 85215759, 86200661, 86214118; U.S. Pat. Nos. 5,017,156; 5,779,489.

BRIEF SUMMARY OF THE INVENTION

A main object of the present invention is to provide an electrical connector mounted to a mother board through a cutout defined therein. The connector comprises a boardlock which can reduce the height of the connector above the circuit board, thus promoting space conservation.

The main feature of this invention is that the electrical connector includes boardlocks engaging with the mother board above a bottom face of the connector thereby reducing the height of the connector above the mother board.

Accordingly, a pair of the boardlocks is formed on a front shell of the connector. Each boardlock comprises two resilient legs. Each leg forms a barb at an end thereof. When the boardlocks are engaged with corresponding mounting holes defined in the mother board, the connector is received in a cutout defined in the mother board and the height of the connector above the circuit board is reduced.

Another feature of this invention is that the housing of the connector has standoffs to support the boardlocks, thereby preventing the boardlocks from becoming damaged.

Other objects, advantages and novel features of the invention will become more apparent from the following detailed description when taken in conjunction with the accompanying drawings.

DETAILED DESCRIPTION OF THE INVENTION

Figure 1:
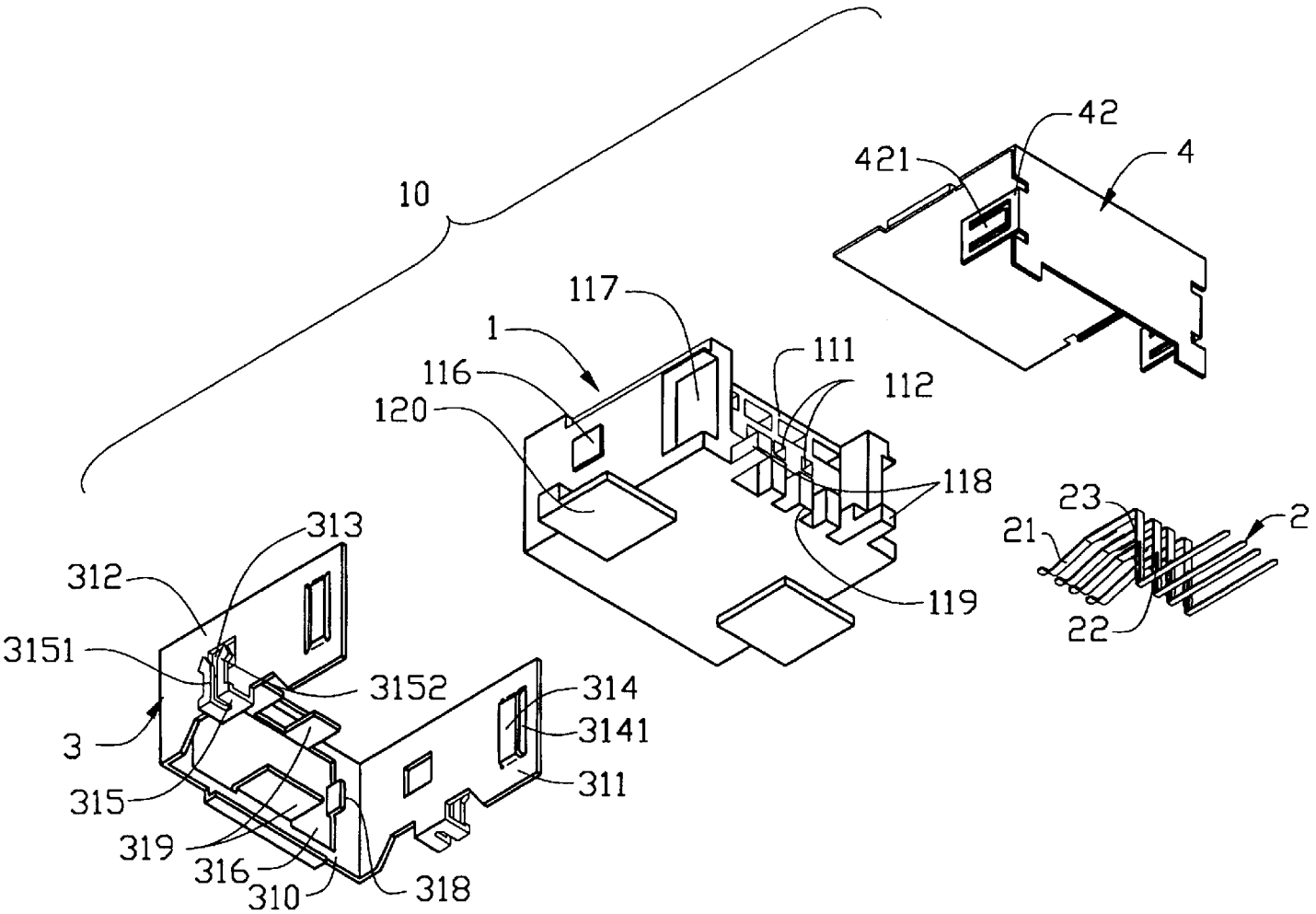
FIG. 1 is an exploded view of an electrical connector in accordance with the present invention.
Figure 2:
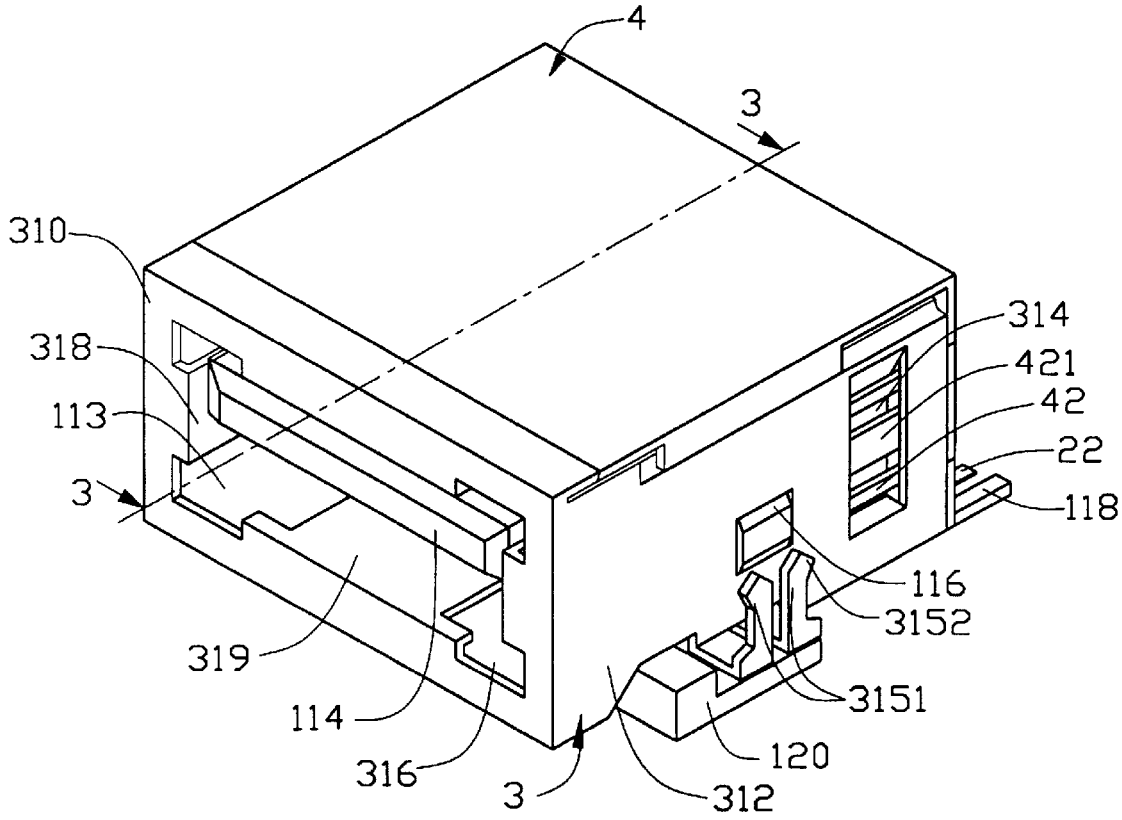
FIG. 2 is an assembled view of FIG. 1.
Figure 3:
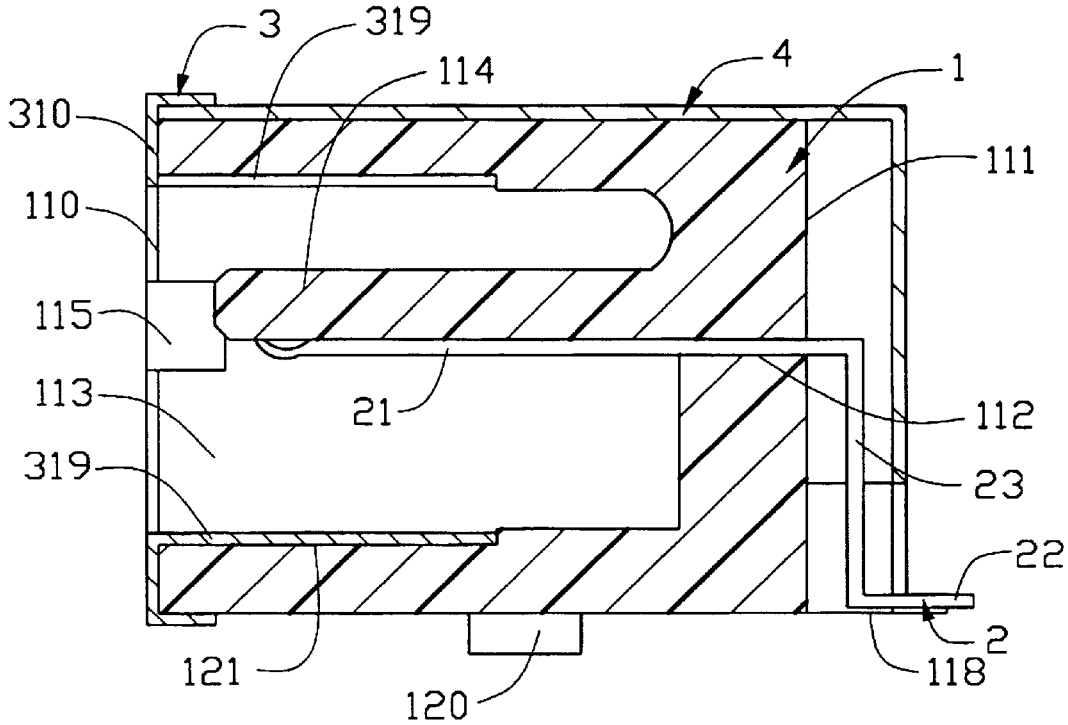
FIG. 3 is a cross sectional view taken along line 3—3 of FIG. 2.
Figure 4:
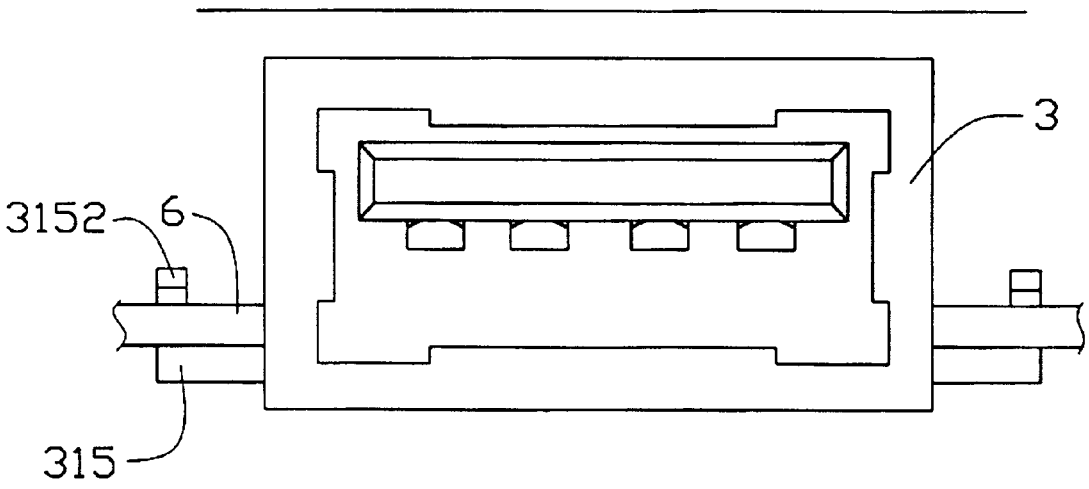
FIG. 4 is a plan view of the electrical connector in accordance with the present invention without showing the standoffs thereof, and a printed circuit board.
Figure 7:
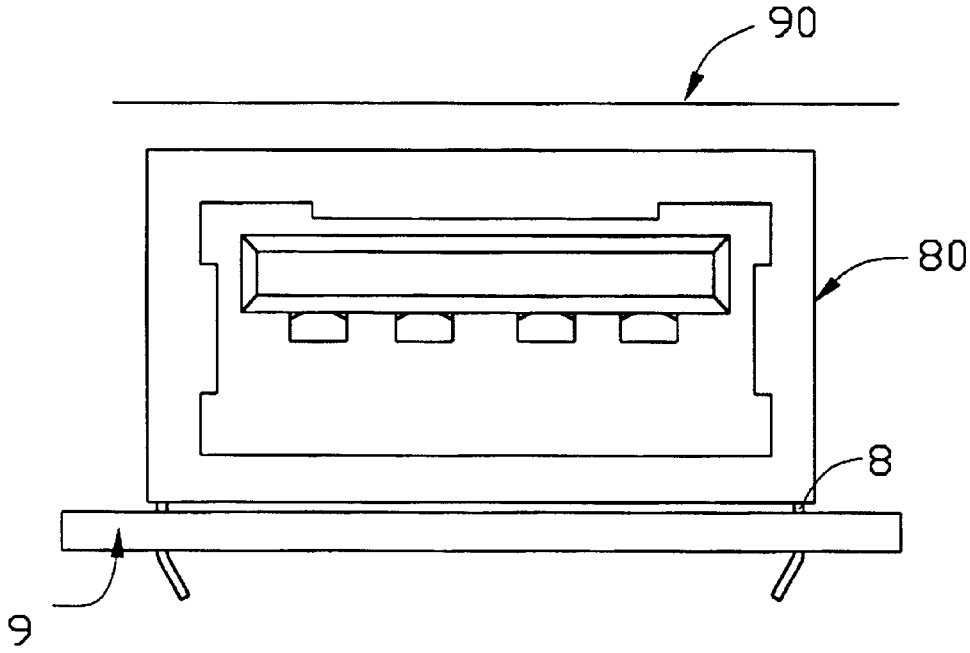
FIG. 7 (PRIOR ART)
FIG. 7 is an assembled view of the electrical connector of FIG. 6 and a printed circuit board.

FIGS. 1 to 4 refer to the first embodiment of this invention, wherein an electrical connector 10 comprises a housing 1, contacts 2, a front shell 3, and a rear shell 4. The rectangular housing 1 has a mating face 110 and a mounting face 111. Four passageways 112 are defined between the mating face 110 and the mounting face 111. The contacts 2 are received in the passageways 112. A mating channel 113 is disposed in the mating face 110 for engaging a mating connector (not shown). A contact retainer 114 extends into the mating channel 113. When the mating connector is inserted into the mating channel 113, the contact retainer 114 increases the engaging area therebetween, thus the contacts 2 can properly engage mating contacts (not shown) of the mating connector.

The housing 1 defines two notches 115 in opposite inner lateral faces thereof. A pair of recesses 121 is defined in opposite inner horizontal faces of the housing 1. Each lateral side of the housing 1 forms a protrusion 116 and a cutout 117. Two support rods 118 extend from the mounting face 111 of the housing 1. Three blocks 119 are formed between the support rods 118. Two standoffs 120 outwardly extend from a bottom face of the housing 1.

Each contact 2 forms a contact section 21, a tail 22, and a intermediate section 23. The contact sections 21 extend through the passageways 112 and engage the mating contacts of the mating connector. The tails 22 are soldered on a printed circuit board 6. The blocks 119 ensure that a short circuit is not formed between the tails 22 thereby ensuring proper signal transmission.

The front shell 3 comprises a first face 310, a second face 311, and a third face 312. The second face 311 and the third face 312 each form an engaging hole 313 and a plate 314 for engaging with the protrusions 116 and the cutouts 117 of the housing 1, respectively. Two slots 3141 are defined at forward and rearward edges of each plate 314.

An L-shaped boardlock 315 upwardly extends from a bottom edge of each side of the front shell 3 and is further supported by the corresponding standoff 120. Each boardlock 315 comprises two legs 3151 with a barb 3152 formed at a free end of each leg 3151. When the barbs 3152 are engaged in a corresponding mounting hole in a printed circuit board 6, the electrical connector 10 is firmly mounted on the printed circuit board 6, and the height of the connector 10 above the circuit board 6 is reduced. It is understood that the printed circuit board 6 defines a cutout extending inwardly from an edge thereof so that the connector 10 is loaded to the circuit board 6 from the bottom until the standoffs 120 abut against the underside of the circuit board 6, wherein the connector 10 extends through and occupies such a cutout, and extends beyond the upper side and the underside of the circuit board 6.

An opening 316 is defined in the first face 310 of the front shell 3 for insertion of the mating connector therethrough. A pair of engaging tabs 318 inwardly extends from opposite lateral peripheries of the opening 316 and is received in the corresponding notches 115 of the housing 1. A plurality of grounding tabs 319 inwardly extends from opposite horizontal peripheries of the opening 316 and is received in the corresponding recesses 121 defined in the housing 1.

The rear shell 4 covers a rear portion of the housing 1 and forms two engaging pieces 42 for insertion into the slots 3141 of the front shell 3 thereby attaching the rear shell 4 to the front shell 3. Each engaging piece 42 has an engaging tab 421.

Figure 5:
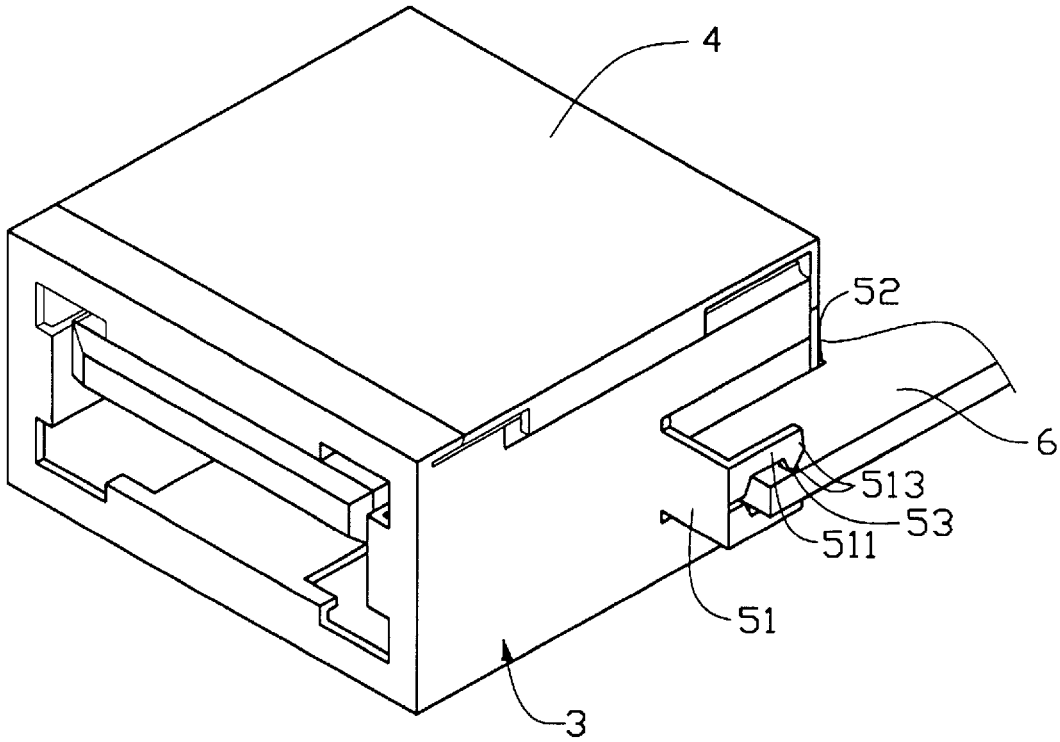
FIG. 5 is a perspective view of an electrical connector of a second embodiment of the present invention attached to the printed circuit board.
Figure 6:
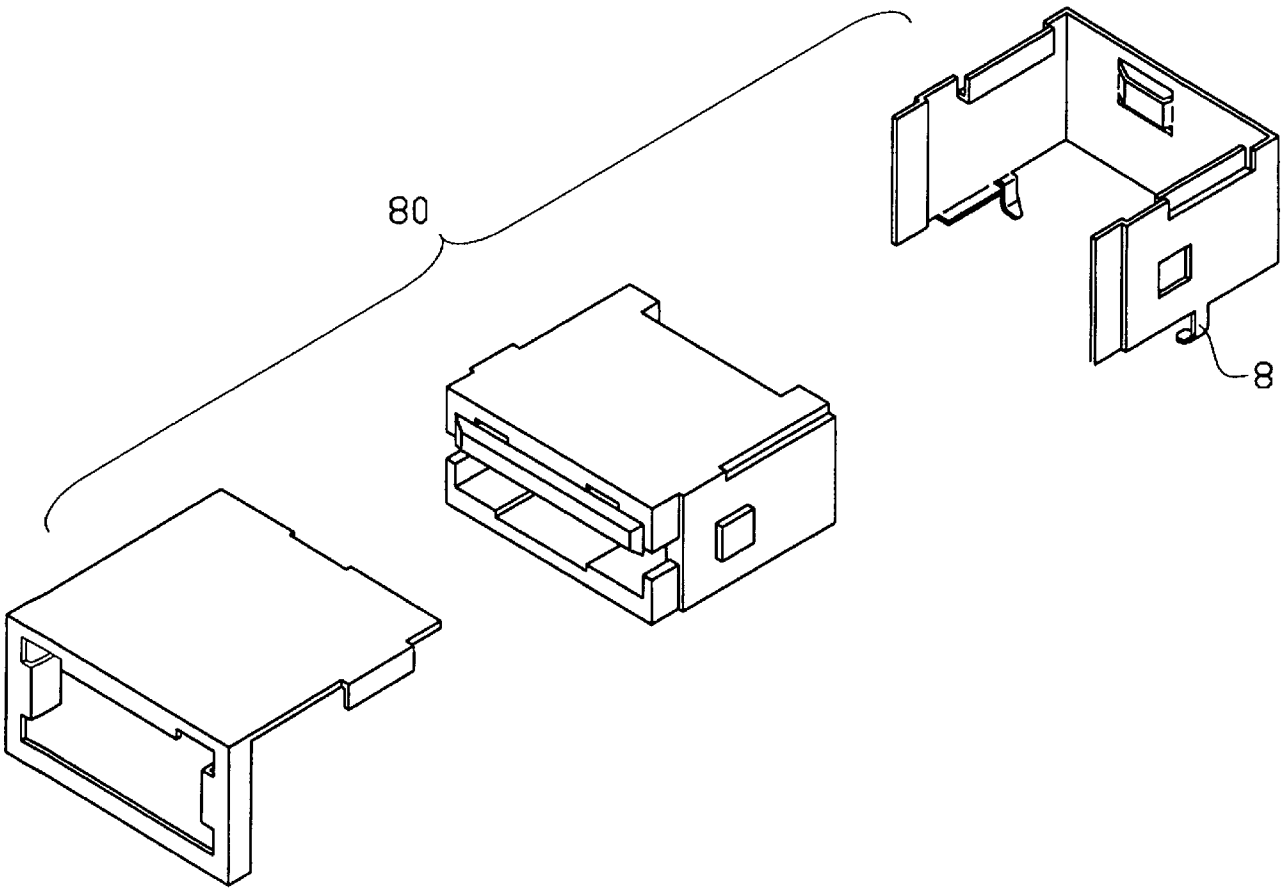
FIG. 6 (PRIOR ART)
FIG. 6 is an exploded view of a conventional electrical connector.

FIG. 5 illustrates a second embodiment of the present invention. A pair of L-shaped boardlocks 51 rearwardly extends from opposite sides of the front shell 3 along the direction of insertion of a mating connector. A cutout 52 is defined in the printed circuit board 6. A pair of mounting holes 53 is defined in the circuit board 6 on opposite sides of the cutout 52. Each boardlock 51 has two legs 511 with a barb 513 formed at a free end of each leg 511 for engaging with the mounting holes 53. When the electrical connector 10 is mounted to the printed circuit board 6, the front shell 3 engages with the rear shell 4 and the height of the electrical connector 10 above the circuit board 6 is reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector of the type for mounting to a printed circuit board defining a plurality of mounting holes and a cutout, comprising:

an insulative housing having a mating face, a mounting face two lateral sides, a plurality of contact passageways defined between the mating face and the mounting face, a mating channel defined in the mating face, and a bottom face;

a plurality of contact terminals each comprising a contact section received in the corresponding contact passageway, an intermediate section downwardly extending from the contact passageway, and a tail outwardly extending from the mounting face; and a shielding frame covering the housing and comprising a front shell, a rear shell, and a pair of boardlocks extending from opposite sides of the front shell for engaging with the mounting holes defined in the printed circuit board, the bottom face of the insulative housing being positioned at a level below the circuit board;

wherein each boardlock is L-shaped and extends upwardly to engage the corresponding mounting hole of the printed circuit board from the underside thereof.

2. The electrical connector as claimed in claim 1, wherein each boardlock outwardly extends from the front shell and is bent rearwardly to extend along the direction of insertion of a mating connector.

3. The electrical connector as claimed in claim 1, wherein each boardlock has two resilient legs, each leg forming a barb on an end thereof to lock the connector onto the circuit board.

4. The electrical connector as claimed in claim 1, wherein the front shell forms an opening therein and a plurality of grounding tabs on a periphery of the opening, the tabs extending inwardly and contacting an inserted mating connector for grounding purposes.

5. The electrical connector as claimed in claim 1, wherein the front shell forms a plate and the rear shell forms an engaging piece for engaging the plate of the front shell, the engaging piece having an engaging tab.

6. The electrical connector as claimed in claim 1, wherein the housing forms a standoff on each side thereof for supporting the boardlocks.

7. The electrical connector as claimed in claim 1, wherein the housing comprises a plurality of protrusions, cutouts, and notches and the front shell comprises a plurality of engaging holes, plates, and engaging tabs, each protrusion engaging the corresponding engaging hole, each cutout receiving the corresponding plate, and each notch receiving the corresponding engaging tab.

8. The electrical connector as claimed in claim 1, wherein the housing comprises a pair of support rods extending rearward from the mounting face and a plurality of blocks between the support rods for preventing adjacent contacts from forming a short circuit therebetween.

9. An electrical connector assembly comprising:

an insulative housing defining a mating face and a mounting face;

a plurality of contact terminals positioned within the housing, each of said contact terminals including a contact section around the mating face and a tail around the mounting face;

a shielding frame covering the housing;

a pair of standoffs positioned by two sides of the housing;

a pair of boardlocks integrally formed with the shielding frame and positioned at two sides of the housing and extending upwardly from a bottom face of the housing;

a printed circuit board defining a top side, a bottom side and a cutout extending therethrough, the housing being upwardly assembled to the circuit board extending through said cutout, wherein the standoffs abut against the bottom side of the circuit board while a free end of the boardlock engages the top side thereof.

10. The assembly as claimed in claim 9, wherein said boardlocks are integrally formed with the shielding frame.

11. The assembly as claimed in claim 10, wherein said boardlocks are supported by the standoffs, respectively.

12. An electrical connector assembly comprising:

an insulative housing defining a mating face and a mounting face;

a plurality of contact terminals positioned within the housing, each of said contact terminals including a contact section around the mating face and a tail around the mounting face;

a shielding frame covering the housing;

a pair of boardlocks integrally formed with the shielding frame and positioned at two sides of the housing;

a printed circuit board defining a top side, a bottom side and a cutout extending therethrough, said circuit board further defining a pair of mounting holes by two sides of the cutout, the housing being horizontally assembled to the circuit board in a direction parallel thereto and extending through said cutout, wherein each of said the boardlocks is positioned on both the top side and the bottom side of the printed circuit board and latchably engage with the corresponding mounting hole.

* * * * *